US008567558B2

(12) United States Patent
Nakajima et al.

(10) Patent No.: US 8,567,558 B2
(45) Date of Patent: Oct. 29, 2013

(54) PARTITION PANEL

(75) Inventors: Shinichi Nakajima, Amagasaki (JP); Takahiro Yamada, Amagasaki (JP); Masaji Horio, Amagasaki (JP); Haruo Tabuchi, Komatsu (JP); Kanji Yokoe, Komatsu (JP)

(73) Assignee: Shinko Kenzai Ltd., Hyogo (JP)

( * ) Notice: Subject to any disclaimer, the term of this patent is extended or adjusted under 35 U.S.C. 154(b) by 0 days.

(21) Appl. No.: 13/574,380

(22) PCT Filed: Jan. 19, 2011

(86) PCT No.: PCT/JP2011/000271

§ 371 (c)(1),
(2), (4) Date: Oct. 9, 2012

(87) PCT Pub. No.: WO2011/089905

PCT Pub. Date: Jul. 28, 2011

(65) Prior Publication Data

US 2013/0020148 A1 Jan. 24, 2013

(30) Foreign Application Priority Data

Jan. 21, 2010 (JP) ..... 2010-011318

(51) Int. Cl.
*E04B 1/82* (2006.01)

(52) U.S. Cl.
USPC ..... 181/292; 181/210; 181/288; 181/290

(58) Field of Classification Search
USPC ..... 181/210, 284, 286, 288, 290, 292, 293, 181/295; 52/144, 145
See application file for complete search history.

(56) References Cited

U.S. PATENT DOCUMENTS

| | | | | |
|---|---|---|---|---|
| 2,870,857 | A * | 1/1959 | Goldstein | 181/289 |
| 3,616,139 | A * | 10/1971 | Jones | 428/118 |
| 3,687,223 | A * | 8/1972 | Streck | 181/292 |
| 3,910,374 | A * | 10/1975 | Holehouse | 181/292 |

(Continued)

FOREIGN PATENT DOCUMENTS

| | | |
|---|---|---|
| JP | 58-159309 | 10/1983 |
| JP | 9-228506 | 9/1997 |

(Continued)

OTHER PUBLICATIONS

International Search Report issued Feb. 15, 2011 in International (PCT) Application No. PCT/JP2011/000271.

*Primary Examiner* — Jeremy Luks
(74) *Attorney, Agent, or Firm* — Wenderoth, Lind & Ponack, L.L.P.

(57) ABSTRACT

A partition panel improves sound insulation performance and optimizes a reverberation time. The partition panel has sound absorption and insulation functions, and has a front plate having a perforated section with a plurality of through-holes and an entirely-continuous peripheral edge portion located outside the perforated section. An entirely-continuous back plate is disposed on a side opposite to a sound source across the front plate. An inner perforated plate is disposed between the perforated section of the front plate and the back plate. A front-side honeycomb core is interposed between the perforated section and the inner perforated plate, a back-side honeycomb core is interposed between the back plate and the inner perforated plate and a peripheral honeycomb core is interposed between the peripheral edge portion of the front plate and a region of the back plate opposed to the peripheral edge portion.

7 Claims, 7 Drawing Sheets

(56) References Cited

U.S. PATENT DOCUMENTS

| | | | | | |
|---|---|---|---|---|---|
| 3,948,346 | A * | 4/1976 | Schindler | 181/286 |
| 4,021,983 | A * | 5/1977 | Kirk, Jr. | 52/451 |
| 4,084,366 | A * | 4/1978 | Saylor et al. | 52/791.1 |
| 4,084,367 | A * | 4/1978 | Saylor et al. | 428/113 |
| 4,265,955 | A * | 5/1981 | Harp et al. | 428/116 |
| 4,318,453 | A * | 3/1982 | Rose et al. | 181/292 |
| 5,424,497 | A * | 6/1995 | Dias et al. | 181/290 |
| 5,997,985 | A * | 12/1999 | Clarke et al. | 428/116 |
| 6,274,216 | B1 * | 8/2001 | Gonidec et al. | 428/116 |
| 6,871,725 | B2 * | 3/2005 | Johnson | 181/292 |

FOREIGN PATENT DOCUMENTS

| | | |
|---|---|---|
| JP | 2000-136581 | 5/2000 |
| JP | 2007-309082 | 11/2007 |
| JP | 2008-138505 | 6/2008 |

* cited by examiner

PARTITION PANEL

TECHNICAL FIELD

The present invention relates to a partition panel having a sound absorption function and a sound insulation function.

BACKGROUND ART

Heretofore, as a partition panel designed to be installed onto a wall surface in a room, there has been known a sound absorption panel disclosed in the following Patent Document 1. This sound absorption panel comprises a front liner paper having a plurality of small holes, a back liner paper, and a paper honeycomb core interposed between the two liner papers. The paper honeycomb core has a honeycomb structure, and each of the front liner paper and the back liner paper is bonded to the paper honeycomb core.

However, the sound absorption panel of the Patent Document 1 has a problem of poor sound insulation performance. Specifically, since the entire front liner paper and the entire back liner paper are coupled together through the paper honeycomb core, it allows sound received by one of the front and back liner papers to be easily transmitted to the other through the paper honeycomb core.

Moreover, the sound absorption panel of the Patent Document 1, in which small holes are provided in the entire area of the front liner paper, has too high a sound absorption performance. This may extremely shorten reverberation time in a room and thereby give a strangeness or discomfort to a person in the room.

As a means to solve these problems, it is conceivable, instead of the installment of only the sound absorption panel disclosed in the Patent Document 1 onto a wall surface in a room, to alternately install the sound absorption panel of the Patent Document 1 and a partition panel having no sound absorption function, thus improving the sound insulation performance by the presence of the partition panel having no sound absorption function while generating the reverberation in the room so as to optimize the reverberation time in the room. This approach, however, generates a new problem of a loss of consistency of the wall surface.

LIST OF PRIOR ART DOCUMENTS

Patent Document 1: JP 2000-136581A

SUMMARY OF THE INVENTION

It is an object of the present invention to provide a partition panel capable of improving sound insulation performance and optimizing a reverberation time in a room with no loss of consistency in a wall surface.

The present invention provides a partition panel which has a sound absorption function of absorbing sound given by a sound source and a sound insulation function of insulating the sound. The partition panel comprises: a front plate having a perforated section provided with a plurality of through-holes and a peripheral edge portion which is entirely continuous and located outside the perforated section; a back plate which is entirely continuous and disposed on a side opposite to the sound source across the front plate; an inner perforated plate having a plurality of through-holes disposed between the perforated section of the front plate and the back plate; a front-side honeycomb core having a honeycomb structure interposed between the perforated section of the front plate and the inner perforated plate so as to make contact with the perforated section and the inner perforated plate; a back-side honeycomb core having a honeycomb structure interposed between the back plate and the inner perforated plate so as to make contact with the back plate and the inner perforated plate; and a peripheral honeycomb core having a honeycomb structure interposed between the peripheral edge portion of the front plate and the back plate so as to make contact with the peripheral edge portion and a region of the back plate, which region is opposed to the peripheral edge portion.

Between the perforated section of the front plate and the back plate, there may be interposed a plurality of the inner perforated plates spaced in a direction of arrangement of the front plate and the back plate. In this case, as honeycomb cores, the partition panel only has to include: a front-side honeycomb core having a honeycomb structure interposed between the perforated section of the front plate and a front-side inner perforated plate which is one of the inner perforated plates and is adjacent to the front plate so as to make contact with the perforated section and the front-side inner perforated plate; a back-side honeycomb core having a honeycomb structure interposed between the back plate and a back-side inner perforated plate which is one of the inner perforated plates and is adjacent to the back plate so as to make contact with the back plate and the back-side inner perforated plate; an inner honeycomb core having a honeycomb structure interposed between adjacent inner perforated plates which are ones of the inner perforated plates and are adjacent to each other, so as to make contact with the respective adjacent inner perforated plates; and a peripheral honeycomb core having a honeycomb structure interposed between the peripheral edge portion of the front plate and the back plate so as to make contact with the peripheral edge portion and a region of the back plate which region is opposed to the peripheral edge portion.

DESCRIPTION OF EMBODIMENTS

With reference to the drawings, the present invention will now be described based on an embodiment thereof.

Figure 1:
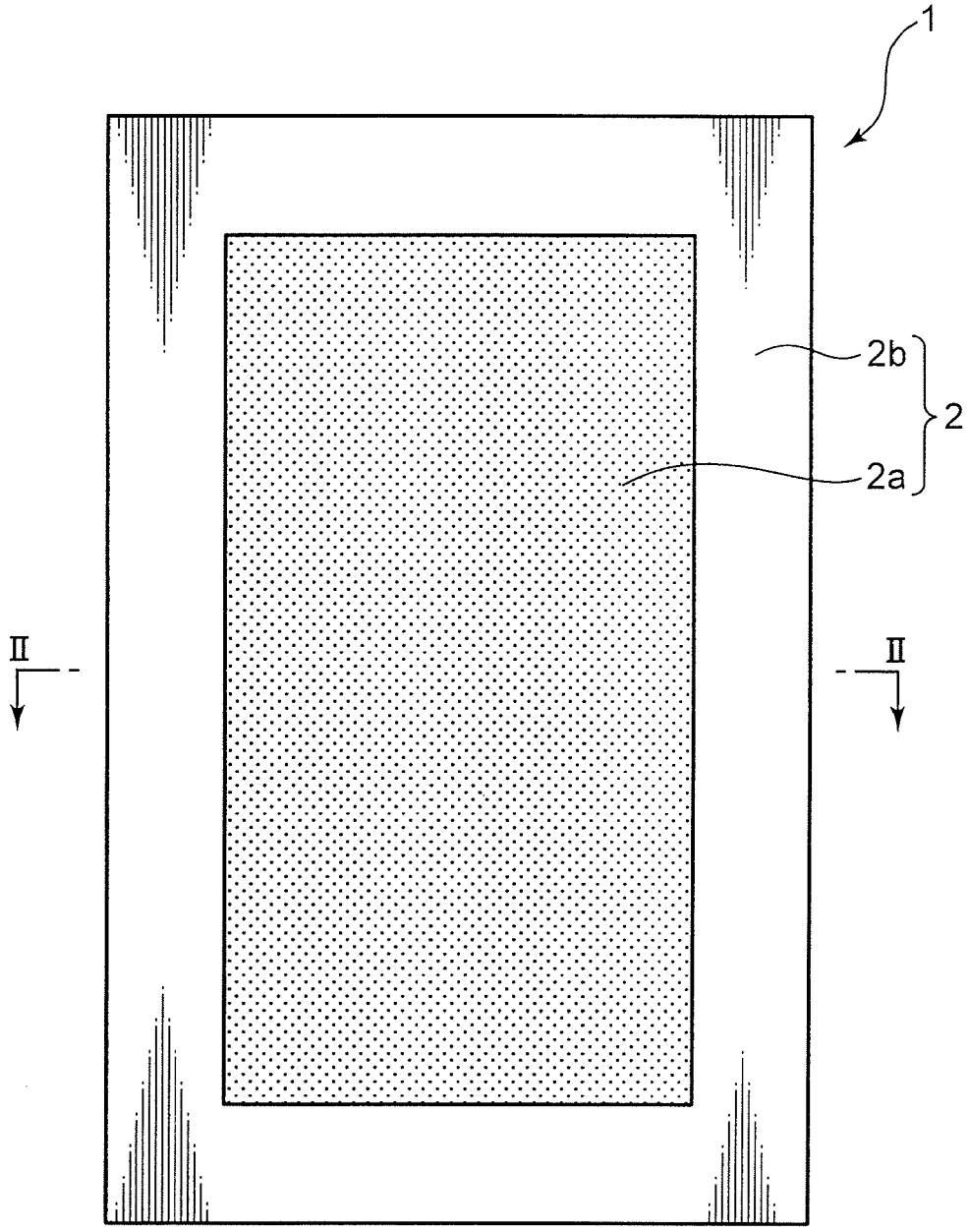
FIG. 1 is a plan view of a partition panel according to a first embodiment of the present invention.
Figure 2A:
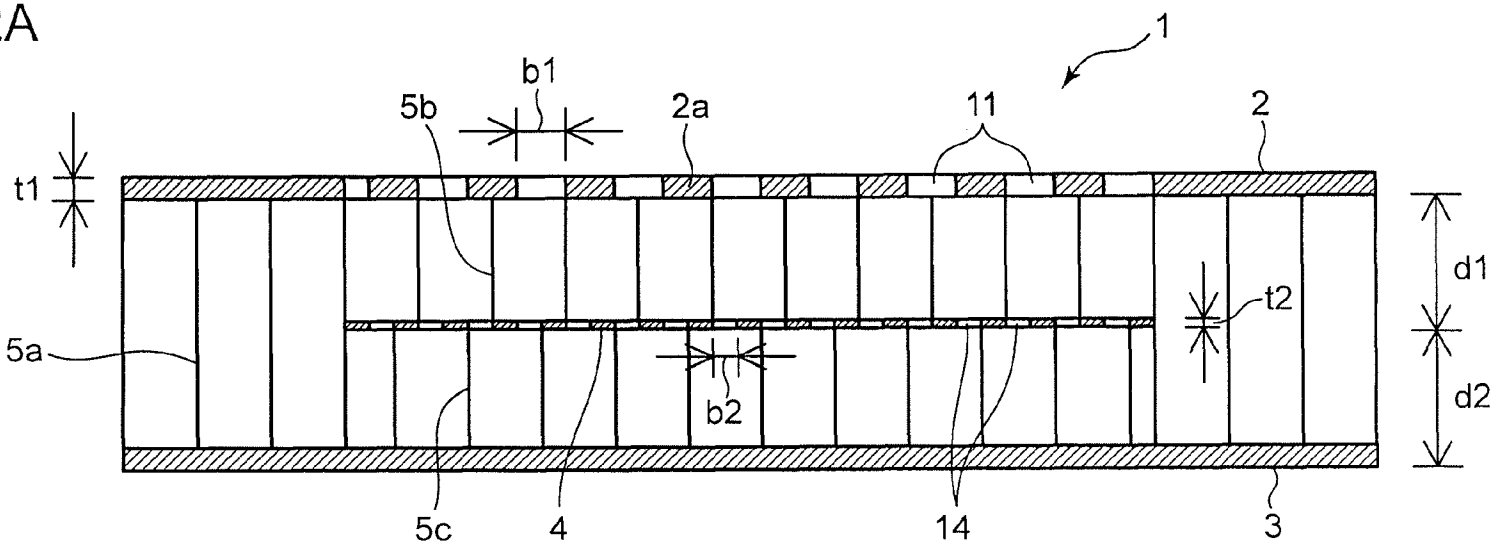
FIG. 2A is a sectional view of the partition panel, taken along line II-II in FIG. 1.
Figure 3:
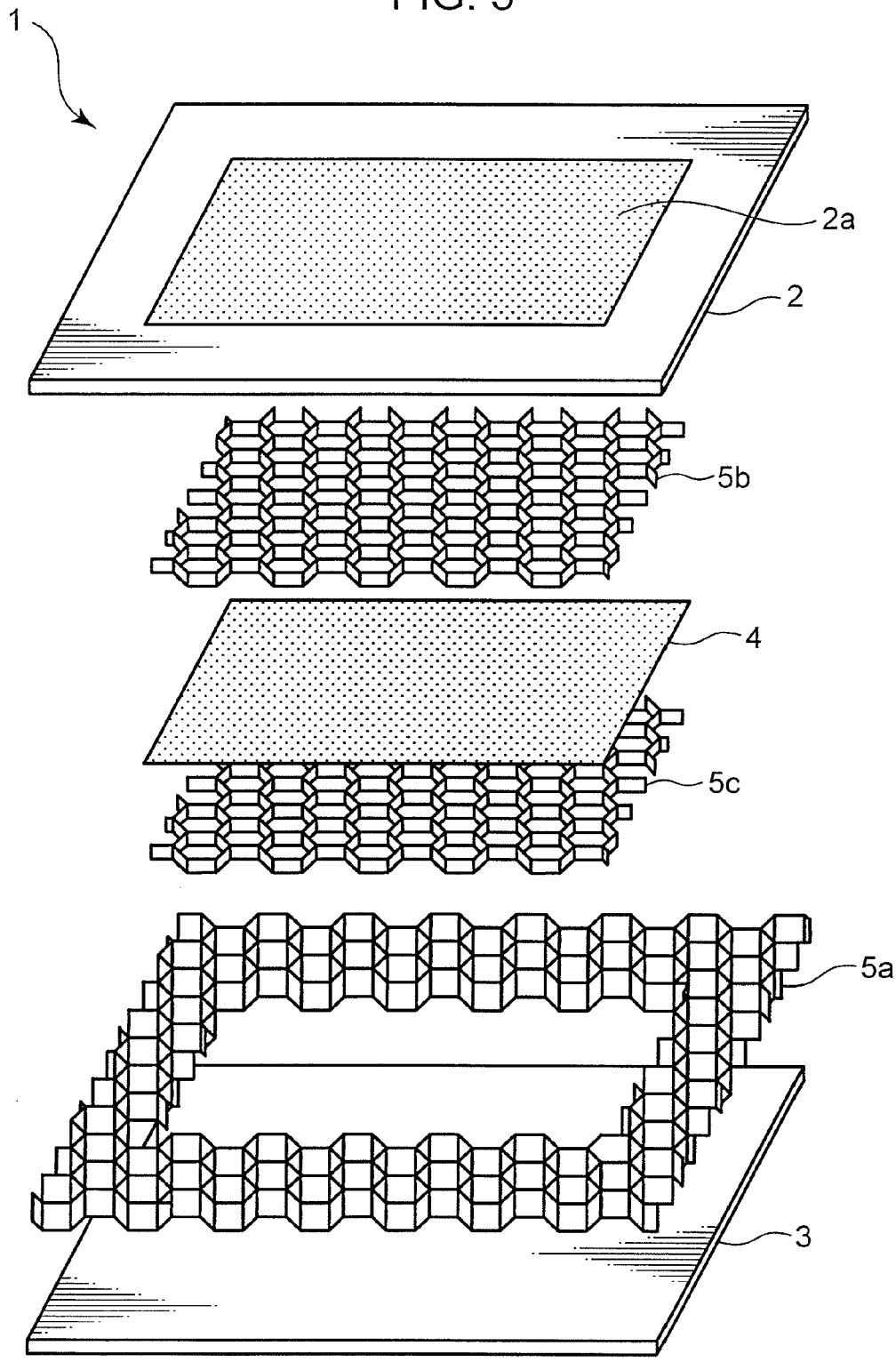
FIG. 3 is perspective view of the partition panel.

FIGS. 1, 2A and 3 show a partition panel 1 according to a first embodiment of the present invention. This partition panel 1, having a sound absorption function of absorbing sound given by a non-illustrated sound source and a sound insulation function of insulating the sound, comprises a front plate 2, a back plate 3, an inner perforated plate 4, a front-side honeycomb core 5*b*, a back-side honeycomb core 5*c* and a peripheral honeycomb core 5*a*.

The front plate 2 is a plain plate to be disposed so as to face the sound source, having a perforated section 2*a* provided with a plurality of through-holes and a peripheral edge portion 2*b* which is located outside (around) the perforated section 2*a* and is entirely continuous, that is, non-perforated. In the illustrated embodiment, the front plate 2 has a rectangular shape.

The back plate 3 is an entirely-continuous, that is, non-perforated, flat plate. In the illustrated embodiment, the back plate 3 has the same rectangular shape as that of the front plate 2. The back plate 3 is disposed on a side opposite to the sound source across the front plate 2, i.e., behind the front plate with respect to the sound source, in a posture parallel to the front plate 2.

The inner perforated plate 4 is provided with a plurality of through-holes 14, and interposed between the perforated section 2*a* of the front plate 2 and the back plate 3, in a posture parallel to the front plate 2 and the back plate 3 and opposed to the perforated section 2*a*.

Figure 2B:
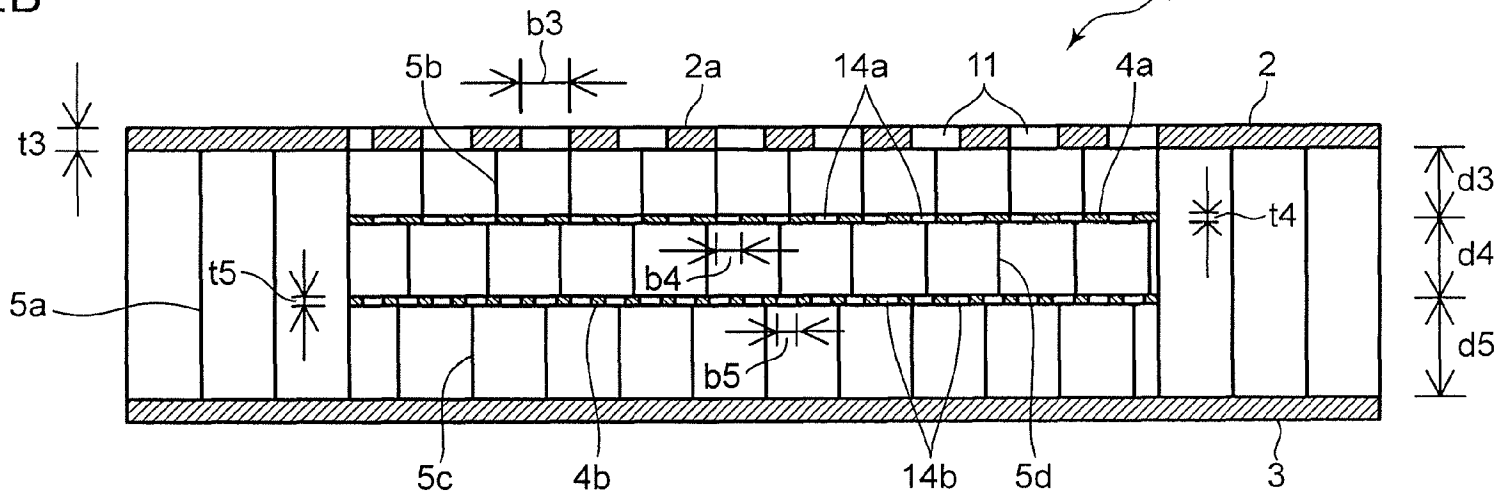
FIG. 2B is a sectional view of a partition panel according to a second embodiment of the present invention, taken along a cut plane equivalent to that of FIG. 2A.

FIG. 2B illustrates a partition panel 1' according to a second embodiment of the present invention. While comprising a front plate 2 and a back plate 3 equivalent to respective ones of the front plate 2 and the back plate 3 of the partition panel 1, the partition panel 1' includes a plurality of (in the illustrated embodiment, two) inner perforated plates 4*a*, 4*b*, in place of the inner perforated plate 4. The inner perforated plates 4*a*, 4*b* are provided with a plurality of through-holes 14*a* and a plurality of through-holes 14*b*, respectively, and disposed between the perforated section 2*a* of the front plate 2 and the back plate 3, in such a posture that the inner perforated plates 4*a*, 4*b* are parallel to the front plate 2 and the back plate 3 and spaced in a direction of arrangement of the front plate 2 and the back plate 3. The inner perforated plate 4*a* is a front-side inner perforated plate which is adjacent to the front plate 2 and opposed to the perforated section 2*a* of the front plate 2, and the inner perforated plate 4*b* is a back-side inner perforated plate which is adjacent to the back plate 3 and opposed to the back plate 3.

In the partition panel 1 illustrated in FIGS. 2A and 3, each of the honeycomb cores 5*a*, 5*b*, 5*c* has a honeycomb structure. The front-side honeycomb core 5*b* is interposed between the perforated section 2*a* of the front plate 2 and the inner perforated plate 4 so as to make contact with the perforated section 2*a* and the inner perforated plate 4, and the back-side honeycomb core 5*c* is interposed between the back plate 3 and the inner perforated plate 4 so as to make contact with the back plate 3 and the inner preformed inner perforated plate 4. The peripheral honeycomb core 5*a* is interposed between the peripheral edge portion 2*b* of the front plate 2 and the back plate 3 so as to make contact with the peripheral edge portion 2*b* and a region of the back plate 3 which region is opposed to the peripheral edge portion 2*b*.

On the other hand, the partition panel 1' illustrated in FIG. 2B comprises a front-side honeycomb core 5*b*, a back-side honeycomb core 5*c*, an inner honeycomb core 5*d* and a peripheral honeycomb core 5*a*. Each of these honeycomb cores has a honeycomb structure. Among them, the front-side honeycomb core 5*b* is interposed between the perforated section 2*a* of the front plate 2 and the front-side inner perforated plate 4*a*, which is the front-side one of the inner perforated plates and adjacent to the front plate 2, so as to make contact with the perforated section 2*a* and the front-side inner perforated plate 4*a*, and the back-side honeycomb core 5*c* is interposed between the back plate 3 and the back-side inner perforated plate 4*b*, which is the inner perforated plates adjacent to the back plate 3, so as to make contact with the back plate 3 and the back-side inner perforated plate 4*b*. The inner honeycomb 5*d* is interposed between the inner perforated plates 4*a*, 4*b* adjacent to each other, so as to make contact with the respective inner perforated plates 4*a*, 4*b*, and the peripheral honeycomb core 5*a* is interposed between the peripheral edge portion 2*b* of the front plate 2 and the back plate 3 so as to make contact with the peripheral edge portion 2*b* and a region of the back plate 3 which region is opposed to the peripheral edge portion 2*b*.

The preferable material for each of the honeycomb cores 5*a*, 5*b*, 5*c*, 5*d* is paper or aluminum.

The partition panel 1 having the one inner perforated plate 4 and shown in FIG. 2A is produced by: placing the frame-shaped peripheral honeycomb core 5*a* on the back plate 3; placing the back-side honeycomb core 5*c*, the inner perforated plate 4 and the front-side honeycomb core 5*b* on the back plate 3 inside the peripheral honeycomb core 5*a*, in this order; placing the front plate 2 thereon; and bonding adjacent ones of the members. In the partition panel 1' having the two inner perforated plates 4*a*, 4*b* shown in FIG. 2B, it is suitable that the back-side honeycomb core 5*c*, the back-side inner perforated plate 4*b*, the inner honeycomb core 5*d*, the front-side inner perforated plate 4*a* and the front-side honeycomb core 5*b* be placed on a surface region of the back plate 3 inside the peripheral honeycomb core 5*a* in this order. Each of the inner perforated plates and the honeycomb core 5 adjacent thereto may be adhesively bonded together, or may not be. Although each of the inner perforated plates 4, 4*a*, 4*b* is depicted as a flat plate shape in FIGS. 2 and 3 for the sake of simplicity, details of their shape will be described later.

The peripheral region of each of the partition panels 1, 1' illustrated in FIGS. 2A and 2B has a single-layer structure in which the peripheral honeycomb core 5*a* is disposed between the front plate 2 and the back plate 3. In contrast, the inner region surrounded by the peripheral region has a multi-layer structure in which the one or more inner perforated plates and a plurality of the honeycomb cores are disposed between the perforated section 2*a* of the front plate 2 and the back plate 3. Specifically, the inner region of the partition panel 1 shown in FIG. 2A, except for the peripheral region thereof, has a two-layer structure in which one inner perforated plate 4 is disposed between the perforated section 2*a* of the front plate 2 and the back plate 3, and the honeycomb cores 5*b*, 5*c* are disposed between the inner perforated plate 4 and the perforated section 2*a* and between the inner perforated plate 4 and the back plate 3, respectively. The inner region of the partition panel 1' shown in FIG. 2B, except for the peripheral region thereof, has a three-layer structure in which the two inner perforated plates 4*a*, 4*b* are disposed between the perforated section 2*a* of the front plate 2 and the back plate 3, and the honeycomb cores 5*b*, 5*c*, 5*d* are disposed between the perforated section 2*a* and the inner perforated plate 4*a*, between the back plate 3 and the inner perforated plate 4*b*, and between the inner perforated plates 4*a*, 4*b*, respectively.

Figure 4A:
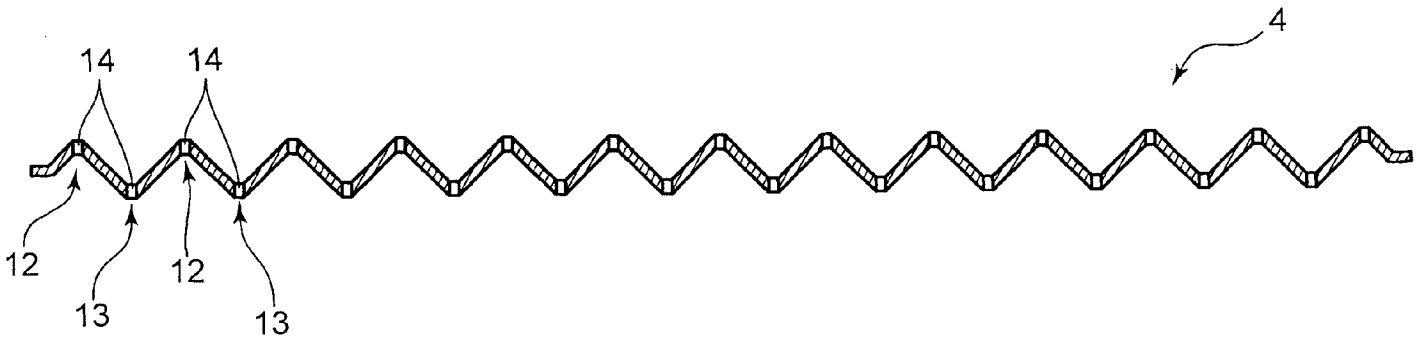
FIG. 4A is a sectional view of an inner perforated plate of the partition panel.
Figure 4B:
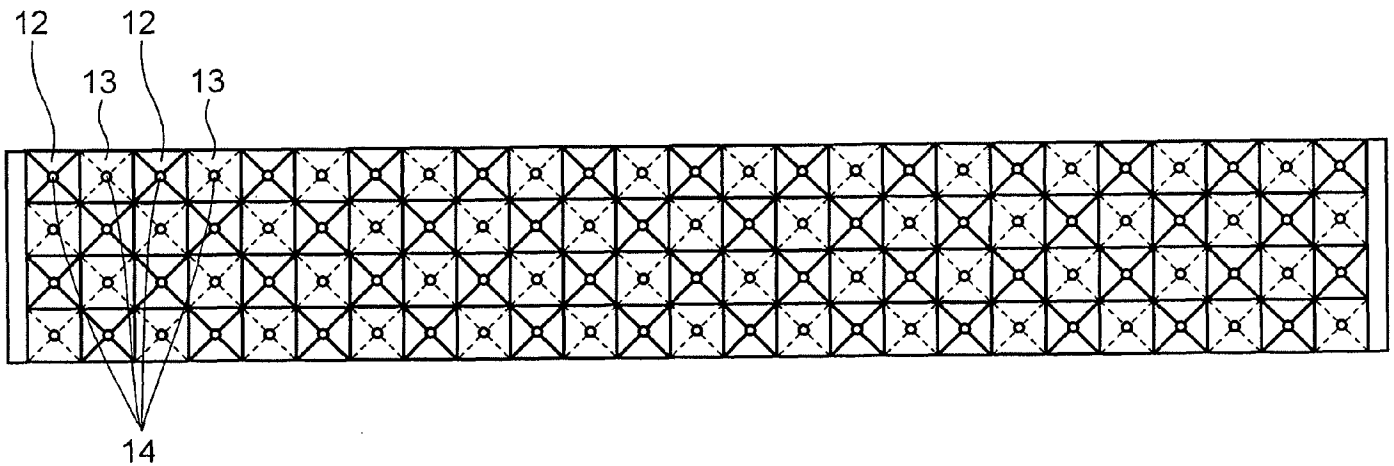
FIG. 4B is a plan view of the inner perforated plate.

Although the shape of each of the inner perforated plates 4, 4*a*, 4*b* may be a simple flat plate shape, preferable examples thereof are shown in FIGS. 4A and 4B. The inner perforated plate 4 shown therein, which is formed by subjecting a metal plate such as an aluminum plate to embossing, has a shape including a plurality of crest-shaped portions 12 and a plurality of trough-shaped portions 13, the crest-shaped portions 12 and the trough-shaped portions 13 being arranged continuously and alternately across the length and breadth of the inner perforated plate 4. One of the crest-shaped portion 12 and the trough-shaped portion 13 is equivalent to a first portion having a shape convexed toward the front plate 2, and the other is equivalent to a second portion having a shape convexed toward the back plate 3. The through-holes 14, each having a minute diameter, are formed together with the crest-shaped portions 12 and the trough-shaped portions 13 by the embossing, at respective peaks of the crest-shaped portions 12 and respective bottoms (peaks when viewed upside down) of the trough-shaped portions 13. The shape of each of the through-holes 14 thus formed by embossing is not a circular shape but in a cross-like shape. The following description will be made with a conversion of the cross-like shaped through-hole into a circular through-hole having an opening area equivalent to that of the cross-like shaped through-hole.

In this inner perforated plate 4, as shown in FIG. 4B, the crest-shaped portion 12 and the trough-shaped portion 13 are formed by embossing alternately and in a zigzag pattern, thereby enhancing rigidity of the inner perforated plate 4. This makes it possible to provide sufficient rigidity to the inner perforated plate 4 even if the thickness thereof is small.

Besides, the inner perforated plate 4 illustrated in FIGS. 4A and 4B has a wavy surface due to the crest-shaped portions 12 and the trough-shaped portions 13, which makes the distance by which sound travels from a point where the sound is propagated from one of the honeycomb cores sandwiching the inner perforated plate 4 therebetween to a point where the sound is propagated to the other honeycomb core be great, as compared with a flat plate-shaped perforated plate. This leads to suppression of sound propagation from one of the honeycomb cores to the other.

Furthermore, the inner perforated plate 4 having the above shape can establish a point contact or similar contact with the adjacent honeycomb core, through the crest-shaped portions 12 and the trough-shaped portions 13. This means that the contact area between the inner perforated plate 4 and the adjacent honeycomb core is extremely small, and, in a non-contact region, there is little sound propagation between the adjacent honeycomb core and the inner perforated plate 4. In other words, continuously forming the crest-shaped portions 12 and the trough-shaped portions 13 as above enables both the enhancement in rigidity of the inner perforated plate 4 and the suppression of sound propagation between the inner perforated plate 4 and the adjacent honeycomb core to be achieved. These effects make it possible to optimally attenuate sound to be propagated between each of the honeycomb cores 5*b*, 5*c*, 5*d* and the inner perforated plate 4 (4*a*, 4*b*).

As shown in FIGS. 2A and 2B, in a peripheral region of each of the partition panels 1 (1'), the sound which one of the peripheral edge portion 2*b* of the front plate 2 and the back plate 3 receives is easily propagated to the other through the honeycomb core 5*a*. Therefore, the sound absorption and the sound insulation performances thereof is low. On the other hand, in an inner region of the partition panel 1 (1') except for the peripheral region, the sound which one of the front plate 2 and the back plate 3 receives is largely attenuated due to vibrational absorption by the honeycomb cores 5*b*, 5*c* (5*b*, 5*c*, 5*d*) and the inner perforated plate 4 (4*a*, 4*b*) before it is propagated to the other. Therefore, the sound absorption and sound insulation performances thereof is high.

In regard to an opening ratio in each of the perforated section 2*a* and the inner perforated plate 4, the opening ratio is preferably set so as to decrease in a stepwise manner with distance from a sound source. Specifically, in the partition panel 1 shown in FIG. 2A, the inner perforated plate 4 has an opening ratio β2 less than an opening ratio β1 of the perforated section 2*a*. In the partition panel 1' shown in FIG. 2B, the inner perforated plate 4*a* and the inner perforated plate 4*b* have, respectively, an opening ratio β4 and an opening ratio β5 each less than an opening ratio β3 of the perforated section 2*a*, wherein the opening ratio β5 of the inner perforated plates 4*b* located farther from the sound source is less than the opening ratio β4 of the inner perforated plate 4*a* located closer to the sound source. As used here, the opening ratio of the perforated section 2*a* is a value obtained by dividing a sum of respective opening areas of all of the through-holes 11 by the entire area of the perforated section 2*a*, and the opening ratio of the inner perforated plate 4 (4*a*, 4*b*) is a value obtained by dividing a sum of respective opening areas of all of the through-holes 14 (14*a*, 14*b*) by the entire area of the inner perforated plate 4 (4*a*, 4*b*).

In FIG. 2A, for example, the distance d1 from the front plate 2 to the inner perforated plate 4 is 18 mm, and the distance d2 from the inner perforated plate 4 to the back plate 3 is 18 mm. The hole diameter b1 of each of the through-holes 11 of the perforated section 2*a* is 0.8 mm, and the opening ratio β1 of the perforated section 2*a* is 8.0% or less. The hole diameter b2 of each of the through-holes 14 of the inner perforated plate 4 is 0.1 mm, and the opening ratio β2 of the inner perforated plate 4 is 1.0% or less. The plate thickness t1 of the front plate 2 (perforated section 2*a*) is 0.6 mm, and The plate thickness t2 of the inner perforated plate 4 is 0.1 mm.

In FIG. 2B, for example, the distance d3 from the front plate 2 to the inner perforated plate 4*a*, the distance d4 from the inner perforated plate 4*a* to the inner perforated plate 4*b*, and the distance d5 from the inner perforated plate 4*b* to the back plate 3, are 10 mm, 10 mm and 16 mm, respectively. The hole diameter b3 of each of the through-holes 11 of the perforated section 2*a* is 0.8 mm, and the opening ratio β3 of the perforated section 2*a* is 8.0% or less. The hole diameter b4 of each of the through-holes 14*a* of the inner perforated plate 4*a* is 0.1 mm, and the opening ratio β4 of the inner perforated plate 4*a* is 1.0% or less. The hole diameter b5 of each of the through-holes 14*b* of the inner perforated plate 4*b* is 0.1 mm, and the opening ratio β5 of the inner perforated plate 4*b* is 0.5% or less. The plate thickness t3 of the front plate 2 (perforated section 2*a*), the plate thickness t4 of the inner perforated plate 4*a*, and the plate thickness t5 of the inner perforated plate 4*b*, are 0.6 mm, 0.1 mm and 0.1 mm, respectively.

If, as mentioned above, each of the perforated section 2*a* and the inner perforated plate 4 (4*a*, 4*b*) has the opening ratio which decreases in a stepwise manner with distance from a sound source, it is possible to absorb wideband sound because the number of resonant frequencies absorbable based on the Helmholtz resonance principle becomes great.

As to the inner region of the partition panel 1 (1') except for the peripheral region, it is preferable to set respective thicknesses d of spatial layers segmented by the front plate 2, the inner perforated plate 4 (4*a*, 4*b*), the honeycomb cores 5*b*, 5*c* (5*b*, 5*c*, 5*d*) and the back plate 3, respective opening ratios 13 of the perforated section 2*a* of the front plate 2 and the inner perforated plate 4 (4*a*, 4*b*), respective plate thicknesses t of the perforated section 2*a* and the inner perforated plate 4 (4*a*, 4*b*), and respective hole diameters b of the through-holes 11, 14 (14*a*, 14*b*) so as to produce a viscous damping action against air passing through the through-holes 11, 14 (14*a*, 14*b*) in the perforated section 2*a* and the inner perforated plate 4 (4*a*, 4*b*). The viscous damping action is thereby produced against air passing through the through-holes 11, 14 (14*a*, 14*b*), allowing air vibration (sound) to be converted to thermal energy and attenuated, resulting in a sound absorption effect exerted in a relatively wide frequency range.

On the other hand, in the peripheral region of the partition panel 1 (1'), where the front plate 2 is continuous with no through-hole 11, the front plate 2 reflects sound back without absorbing it. This makes it possible to generate reverberation in a room with an optimal reverberation time.

Besides, the partition panel 1 (1'), having an external appearance in which the perforated section 2*a* is provided in a central region of the front plate 2 as shown in FIG. 1, allows consistency to be kept even if a plurality of the partition panels 1 (1') are consecutively arranged on a wall surface. The partition panel 1 (1') is capable of being used for a ceiling. On the other hand, the peripheral region of the partition panel 1 (1'), having a single-layer structure in which the front plate 2 and the back plate 3 are strongly coupled to the honeycomb core 5*a*, prevents the partition panel 1 (1') from losing its rigidity.

As above, the peripheral region of the partition panel 1 (1') has a single-layer structure in which the peripheral honeycomb core 5*a* is disposed between the front plate 2 and the back plate 3, whereas the inner region of the partition panel 1 (1') except the peripheral region has a multi-layer structure in which the one or more inner perforated plates 4 (4*a*, 4*b*) are interposed between the perforated section 2*a* of the front plate 2 and the back plate 3, and the honeycomb cores 5*b*, 5*c* (honeycomb cores 5*b*, 5*c*, 5*d*) are disposed between them. In the inner region, the sound which one of the front plate 2 and the back plate 3 receives is largely attenuated due to vibrational absorption by the honeycomb cores 5*b*, 5*c* (5*b*, 5*c*, 5*d*) and the inner perforated plate 4 (4*a*, 4*b*) before it is propagated to the other. On the other hand, the peripheral region of the partition panel 1 (1'), where the front plate 2 has no through-hole 11 and reflects sound back without absorbing it, can generate a reverberation with an optimal reverberation time in a room. Besides, the perforated section 2*a* of the front plate 2, provided in a region except for the peripheral region, allows consistency to be kept even if a plurality of the partition panels 1 (1') are consecutively arranged on a wall surface. Improvement in sound insulation performance and optimization of a reverberation time in a room are thus achieved, with no loss of consistency.

Furthermore, as mentioned above, the inner perforated plate 4 including the crest-shaped portions 12 and the through-shaped portions 13 has high rigidity, and effectively suppresses sound propagation between the inner perforated plate 4 (4*a*, 4*b*) and the adjacent honeycomb core. In other words, it is capable of optimally attenuating sound to be propagated between the honeycomb core and the inner perforated plate. In addition, the crest-shaped portions 12 and the through-shaped portions 13 can be formed together with the through-holes 14 (14*a*, 14*b*) by embossing.

Measurement of Sound Transmission Loss

Figure 5:
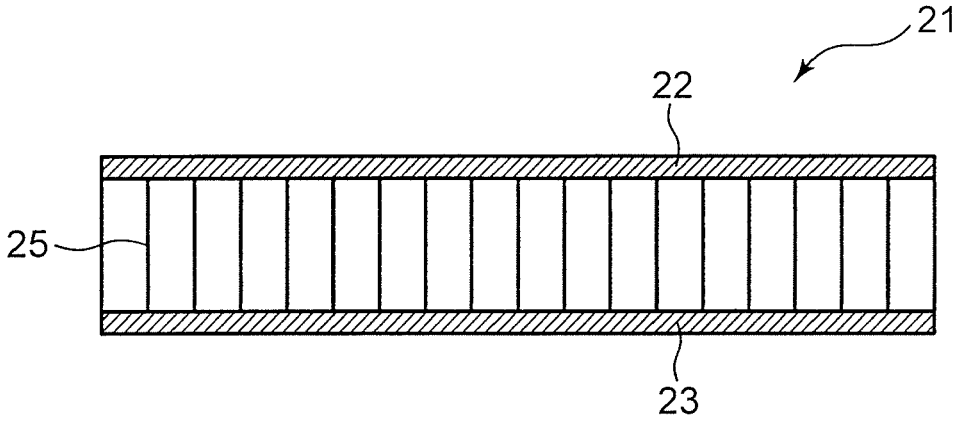
FIG. 5 is a sectional view illustrating a partition panel as a comparative example.

A sound transmission loss was measured for the partition panel according to one embodiment of the present invention, and a partition panel 21 illustrated in FIG. 5 as a comparative example. The partition panel 21 is a sound insulation panel which comprises a front plate 22 having no through-hole, a back plate 23 having no through-hole, and a honeycomb core 25 interposed between the front plate 22 and the back plate 23, wherein each of the two plates 22, 23 are bonded to the honeycomb core 25. On the other hand, as a partition panel according to one embodiment of the present invention, used was the partition panel 1 having the one inner perforated plate 4 as illustrated in FIG. 2A.

Figure 6:
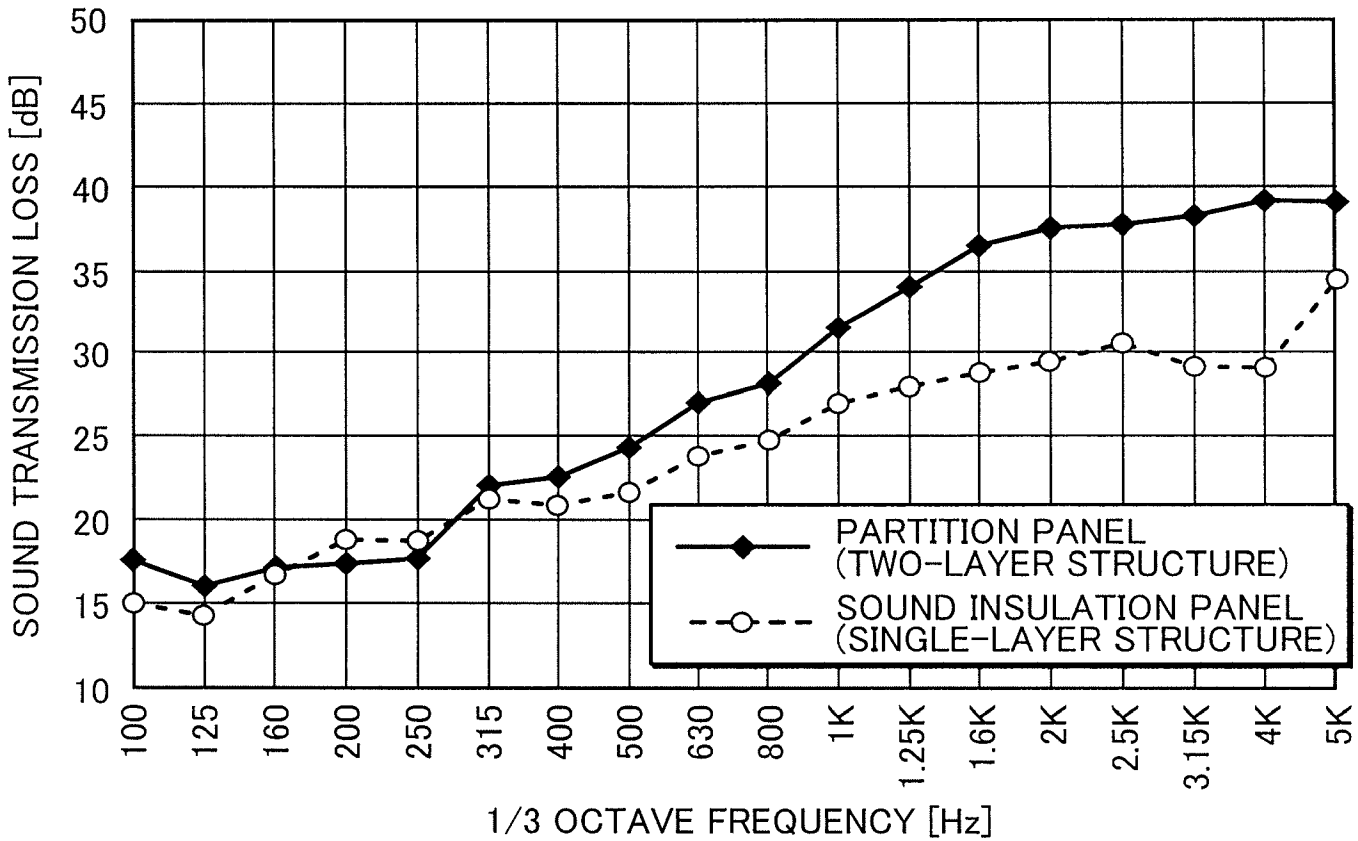
FIG. 6 is a graph showing a result of a measurement of sound transmission loss in respective partition panels of the present invention and the comparative example.

FIG. 6 shows a result of the measurement. FIG. 6 shows a vertical axis representing sound transmission loss (dB) and a horizontal axis representing ⅓ octave band frequency (Hz). FIG. 6 teaches that the partition panel 1 according to the first embodiment, which has a two-layer structure including the one inner perforated plate 4 between the front plate 2 and the back plate 3 in the inner region except the peripheral region, has greater sound transmission loss (sound insulation performance) than that of the partition panel (sound insulation panel) 21 having a single-layer structure. Thus, it is proven that a multi-layer structure can largely attenuate sound during the course of propagation, as compared to the single-layer structure.

Other Embodiments

The present invention is not limited to the above embodiments. A specific configuration and other design matters may be appropriately changed. The functions and effects described in connection with the above embodiments are no more than examples of most desirable functions and effects to be created from the present invention, and functions and effects of the present invention are not limited to those described in connection with the above embodiments.

Figure 7:
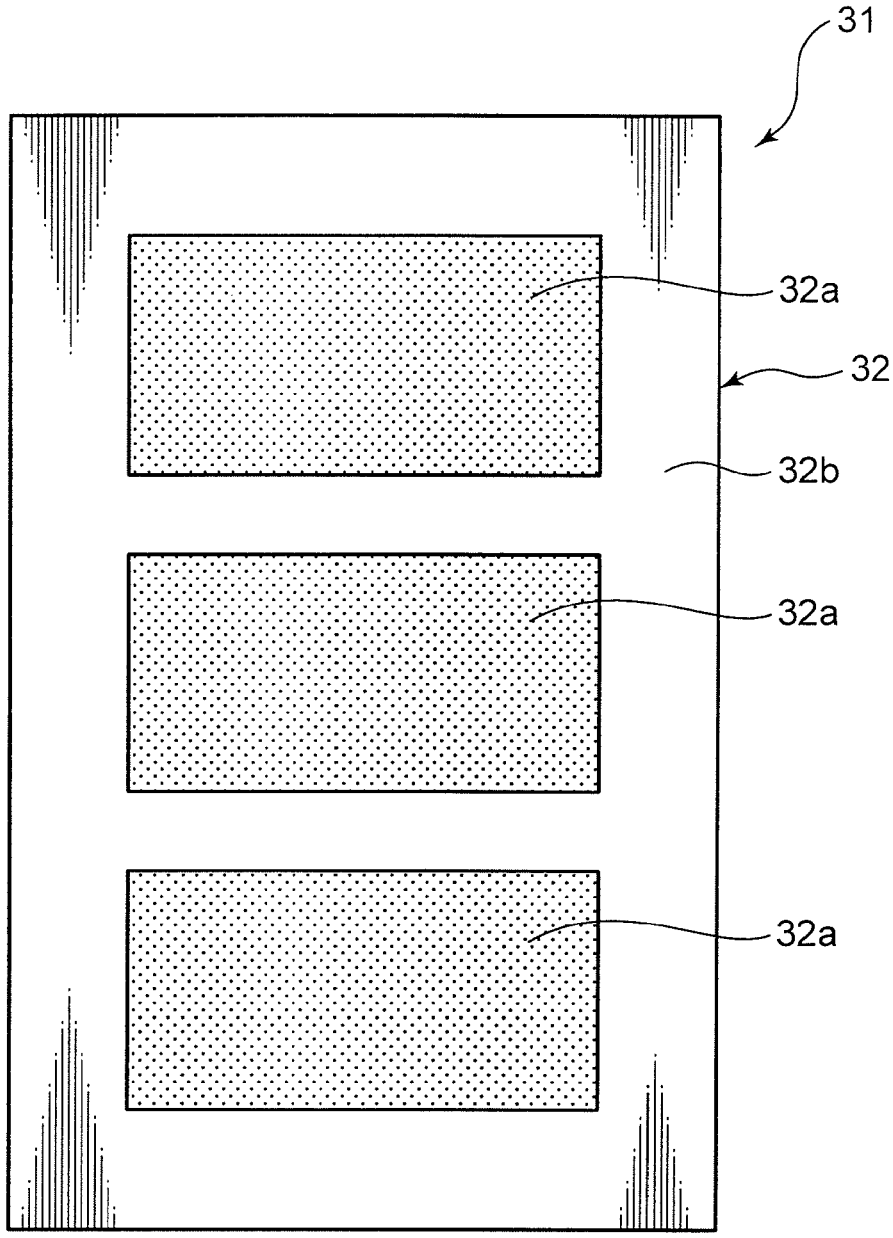
FIG. 7 is a plan view of a partition panel according to another embodiment of the present invention and other than the partition panel shown in FIG. 1.

For example, while the front panel 2 of the partition panel 1 illustrated in FIG. 1 has the perforated section 2*a* in a central region except the peripheral region thereof, a partition panel 31 shown in FIG. 7 is also effective. The partition panel 31 comprises a front plate 32 having a plurality of perforated sections 32*a* isolated from each other and a peripheral edge portion 32*b* surrounding the perforated sections 32*a*. In this case, there may be disposed a plurality of inner perforated plates at respective positions opposed to the perforated sections 32*a*, or there may be disposed at least one large inner perforated plate at a position opposed to the entire region covering all of the perforated sections 32*a*.

While, in the above embodiments, the through-holes 14 of the inner perforated plate 4 are formed by embossing. Alternatively, the through-holes 14 (14*a*, 14*b*) may be formed by any other suitable process, such as punching.

In the present invention, respective opening ratios of the perforated section and the inner perforated plate(s) may be set to the same value. Alternatively, in a partition panel comprising a plurality of inner perforated plates, each of the inner perforated plates may have the same opening ratio, and the perforated section may have an opening ratio different from the opening ratio of the inner perforated plate.

The material forming the inner perforated plate 4 (4*a*, 4*b*) is not limited to aluminum, but various materials having vibration damping (attenuating) ability may be used. The use of such a material makes it possible to suppress sound propagation between the honeycomb core and the inner perforated plate.

As mentioned above, the present invention provides a partition panel which is capable of improving sound insulation performance and optimizing a reverberation time in a room, with no loss of consistency of unity in a wall surface. The partition panel has a sound absorption function of absorbing sound given by a sound source and a sound insulation function of insulating the sound, comprising: a front plate having a perforated section provided with a plurality of through-holes, and a peripheral edge portion which is entirely continuous and located outside the perforated section; a back plate which is entirely continuous and disposed on a side opposite to the sound source across the front plate; an inner perforated plate having a plurality of through-holes and being disposed between the perforated section of the front plate and the back plate; a front-side honeycomb core having a honeycomb structure and being interposed between the perforated section of the front plate and the inner perforated plate so as to make contact with the perforated section and the inner perforated plate; a back-side honeycomb core having a honeycomb structure and being interposed between the back plate and the inner perforated plate so as to make contact with the back plate and the inner perforated plate; and a peripheral honeycomb core having a honeycomb structure and being interposed between the peripheral edge portion of the front plate and the back plate so as to make contact with the peripheral edge portion and a region of the back plate which region is opposed to the peripheral edge portion.

Between the perforated section of the front plate and the back plate, there may be interposed a plurality of the inner perforated plates spaced in a direction of arrangement of the front plate and the back plate. In this case, as honeycomb cores, the partition panel only have to include: a front-side honeycomb core having a honeycomb structure and being interposed between the perforated section of the front plate and a front-side inner perforated plate which is one of the inner perforated plates and is adjacent to the front plate so as to make contact with the perforated section and the front-side inner perforated plate; a back-side honeycomb core having a honeycomb structure and being interposed between the back plate and a back-side inner perforated plate which is one of the inner perforated plates and is adjacent to the back plate so as to make contact with the back plate and the back-side inner perforated plate; an inner honeycomb core having a honeycomb structure and being interposed between adjacent inner perforated plates which are ones of the inner perforated plates and are adjacent to each other, so as to make contact with the respective adjacent inner perforated plates; and a peripheral honeycomb core having a honeycomb structure and being interposed between the peripheral edge portion of the front plate and the back plate so as to make contact with the peripheral edge portion and a region of the back plate which region is opposed to the peripheral edge portion.

In an inner region of the partition panel of the present invention except for a peripheral region thereof, i.e., a region corresponding to the perforated section of the front plate, where the one or more inner perforated plates are interposed between the perforated section and the back plate and the honeycomb cores are interposed between respective adjacent ones of the plates, the sound which one of the front plate and the back plate receives is largely attenuated due to vibrational absorption by the honeycomb cores and the inner perforated plates before it is propagated to the other. This allows high sound absorption and sound insulation performances to be exerted. On the other hand, in the peripheral region of the partition panel, i.e., a region corresponding to the peripheral edge portion of the front plate, where the entire peripheral edge portion of the front plate is continuous and having no through-hole, the sound which the front plate receives is reflected back with no absorption. This makes it possible to generate reverberation with an optimal reverberation time in a room. Besides, since the perforated section provided inside the peripheral edge portion, consistency is not lost, even if a plurality of the partition panels are consecutively arranged on a wall surface. In other words, it is possible to improve sound insulation performance and optimize a reverberation time in a room with no loss of the consistency in a wall surface.

As to the partition panel of the present invention, it is preferable that an opening ratio of each of the perforated section and the inner perforated plate is set so as to decrease in a stepwise manner with distance from the sound source. Thus setting the opening ratio can increase the number of resonant frequencies of sound which can be absorbed based on the Helmholtz resonance principle, thereby making it possible to absorb sound over a wider frequency band. Specifically, it is preferable that the inner perforated plate has an opening ratio less than an opening ratio of the perforated section of the front plate. Furthermore, in the case of interposing the plurality of inner perforated plates between the perforated section and the back plate, it is preferable that the opening ratio of each of the inner perforated plates is set so as to decrease with distance from the sound source.

The inner perforated plate preferably has a vibration attenuating ability in itself. The vibration attenuating ability possessed by the inner perforated plate makes it possible to optimally attenuate sound to be propagated from the honeycomb core to the inner perforated plate.

At least one of the inner perforated plates preferably has a plurality of first portions each having a shape convexed toward the front plate, and a plurality of second portions each having a shape convexed toward the back plate, the first portions and the second portions being arranged continuously and alternately, wherein the through-holes of the inner perforated plate are provided at respective peaks of the first and second portions. The presence of the first portions and the second portions can enhance rigidity of the inner perforated plate, as compared, for example, to a partition panel in which the inner perforated plate is formed of a simple flat plate. Besides, a reduction in contact area between the inner perforated plate and the adjacent honeycomb can reduce sound to be propagated therebetween.

The first portions, the second portions and the through-holes can be easily formed by embossing.

The invention claimed is:

1. A partition panel that has both a sound absorption function for absorbing sound from a sound source and a sound insulation function for insulating the sound, the partition panel comprising:

a front plate having a perforated section that is provided with a plurality of through-holes and a peripheral edge portion which is entirely continuous and located outside of the perforated section;

a back plate which is entirely continuous and disposed facing a back side of the front plate, wherein a front side of the front plate is for facing the sound source;

an inner perforated plate having a plurality of through-holes, the inner perforated plate being disposed between the perforated section of the front plate and the back plate, and the inner perforated plate having an opening ratio that is less than the opening ratio of the perforated section of the front plate;

a front-side honeycomb core having a honeycomb structure, the front-side honeycomb core being disposed between the perforated section of the front plate and the inner perforated plate so as to contact both the perforated section and the inner perforated plate;

a back-side honeycomb core having a honeycomb structure, the back-side honeycomb core being interposed between the back plate and the inner perforated plate so as to contact both the back plate and the inner perforated plate; and a peripheral honeycomb core having a honeycomb structure, the peripheral honeycomb core being interposed between the peripheral edge portion of the front plate and the back plate so as to contact both the peripheral edge portion and a region of the back plate opposite to the peripheral edge portion.

2. The partition panel of claim 1, wherein the inner perforated plate comprises a plurality of first portions each having a shape convex toward the front plate and a plurality of second portions each having a shape convex toward the back plate, wherein the first portions and the second portions are arranged continuously and alternately along the inner perforated plate, and wherein the through-holes of the inner perforated plate are provided at respective peaks of the first portions and the second portions.

3. The partition panel of claim 2, wherein the first portions, the second portions and the through-holes are formed by embossing.

4. A partition panel that has both a sound absorption function for absorbing sound from a sound source and a sound insulation function for insulating the sound, the partition panel comprising:

a front plate having a perforated section that is provided with a plurality of through-holes and a peripheral edge portion which is entirely continuous and located outside of the perforated section;

a back plate which is entirely continuous and disposed facing a back side of the front plate, wherein a front side of the front plate is for facing the sound source;

a plurality of inner perforated plates each having a plurality of through-holes, the inner perforated plates being disposed between the perforated section of the front plate and the back plate, the inner perforated plates being spaced in a direction between the front plate and the back plate, and each of the inner perforated plates having an opening ratio that is less than the opening ratio of the perforated section of the front plate;

a front-side honeycomb core having a honeycomb structure, the front-side honeycomb core being disposed between the perforated section of the front plate and a front-side one of the inner perforated plates located adjacent to the front plate so as to contact both the perforated section and the front-side one of the inner perforated plates;

a back-side honeycomb core having a honeycomb structure, the back-side honeycomb core being interposed between the back plate and a back-side one of the inner perforated plates located adjacent to the back plate so as to contact both the back plate and the back-side one of the inner perforated plates;

an inner honeycomb core having a honeycomb structure, the inner honeycomb core being interposed between two adjacent ones of the inner perforated plates so as to contact both of the two adjacent ones of the inner perforated plates; and a peripheral honeycomb core having a honeycomb structure, the peripheral honeycomb core being interposed between the peripheral edge portion of the front plate and the back plate so as to contact both the peripheral edge portion and a region of the back plate opposite to the peripheral edge portion.

5. The partition panel of claim 4, wherein the opening ratios of the plurality of inner perforated plates decreases with distance of the inner perforated plates from the front plate.

6. The partition panel of claim 4, wherein at least one of the inner perforated plate comprises a plurality of first portions each having a shape convex toward the front plate and a plurality of second portions each having a shape convex toward the back plate, wherein the first portions and the second portions are arranged continuously and alternately along the inner perforated plate, and wherein the through-holes of the inner perforated plate are provided at respective peaks of the first portions and the second portions.

7. The partition panel of claim 6, wherein the first portions, the second portions and the through-holes are formed by embossing.

* * * * *